US010389068B2

(12) United States Patent
Leigh et al.

(10) Patent No.: US 10,389,068 B2
(45) Date of Patent: Aug. 20, 2019

(54) MULTIPLE CABLE HOUSING ASSEMBLY

(71) Applicant: Hewlett Packard Enterprise Development LP, Houston, TX (US)

(72) Inventors: Kevin Leigh, Houston, TX (US); John Norton, Houston, TX (US)

(73) Assignee: Hewlett Packard Enterprise Development LP, Houston, TX (US)

( * ) Notice: Subject to any disclaimer, the term of this patent is extended or adjusted under 35 U.S.C. 154(b) by 0 days.

(21) Appl. No.: 15/564,792

(22) PCT Filed: Apr. 29, 2015

(86) PCT No.: PCT/US2015/028277

§ 371 (c)(1),
(2) Date: Oct. 6, 2017

(87) PCT Pub. No.: WO2016/175795

PCT Pub. Date: Nov. 3, 2016

(65) Prior Publication Data

US 2018/0115114 A1 Apr. 26, 2018

(51) Int. Cl.

| | |
|---|---|
| ***H01R 13/60*** | (2006.01) |
| ***H01R 13/659*** | (2011.01) |
| ***H01R 13/518*** | (2006.01) |
| ***H01R 24/60*** | (2011.01) |
| *H01R 107/00* | (2006.01) |

(52) U.S. Cl.
CPC ..... *H01R 13/659* (2013.01); *H01R 13/518* (2013.01); *H01R 24/60* (2013.01); *H01R 2107/00* (2013.01)

(58) Field of Classification Search
CPC ..... H01R 13/518; H01R 13/659
USPC ..... 439/701, 540.1, 76.1
See application file for complete search history.

(56) References Cited

U.S. PATENT DOCUMENTS

| | | | |
|---|---|---|---|
| 3,521,332 | A | 7/1970 | Kramer |
| 4,386,752 | A | 6/1983 | Pavlak |
| 4,767,338 | A | 8/1988 | Dennis |
| 5,263,671 | A | 11/1993 | Baum |
| 5,386,487 | A | 1/1995 | Briggs |
| 5,564,939 | A | 10/1996 | Maitani et al. |

(Continued)

FOREIGN PATENT DOCUMENTS

| | | |
|---|---|---|
| CN | 101789575 | 7/2010 |
| JP | 2007317434 | 12/2007 |

(Continued)

OTHER PUBLICATIONS

"QSFP+ in the 40 Gigabit Ethernet Fiber Optic Media Systems" Retrieved from Internet Feb. 20, 2015, http://www.fiber-optic-equipment.com/tag/qsfp-cables >, 6 pps.

(Continued)

*Primary Examiner* — Phuong K Dinh
(74) *Attorney, Agent, or Firm* — Dicke, Billig & Czaja, PLLC

(57) ABSTRACT

One example of a cable assembly includes a housing, a first cable, a first connector board, a second cable, and a second connector board. The first connector board is electrically coupled to the first cable and is at least partially arranged within the housing. The second connector board is electrically coupled to the second cable and is at least partially arranged within the housing.

14 Claims, 11 Drawing Sheets

(56) References Cited

U.S. PATENT DOCUMENTS

| | | | | |
|---|---|---|---|---|
| 5,586,906 | A | 12/1996 | Staros et al. | |
| 5,669,590 | A | 9/1997 | Przewodek | |
| 5,993,237 | A | 11/1999 | Kern, Jr. et al. | |
| 6,062,516 | A | 5/2000 | Rizzo | |
| 6,175,080 | B1 | 1/2001 | Nightingale | |
| 6,216,410 | B1 | 4/2001 | Haberman | |
| 6,219,479 | B1 | 4/2001 | Madden | |
| 6,364,721 | B2 | 4/2002 | Stewart, III | |
| 6,378,811 | B1 | 4/2002 | Potter | |
| 6,669,150 | B2 | 12/2003 | Benoit | |
| 6,808,116 | B1 | 10/2004 | Eslambolchi | |
| 6,887,091 | B1 | 5/2005 | Wu | |
| 6,926,237 | B2 | 8/2005 | Shereyk | |
| 7,044,802 | B2 | 5/2006 | Chiou et al. | |
| 7,055,784 | B2 | 6/2006 | Stigler | |
| 7,119,280 | B1 | 10/2006 | Ray | |
| 7,134,908 | B2 | 11/2006 | Wu | |
| 7,241,163 | B1 | 7/2007 | Ray et al. | |
| 7,294,789 | B1 | 11/2007 | Watthanasintham | |
| 7,318,740 | B1 | 1/2008 | Henry et al. | |
| 7,494,363 | B1 | 2/2009 | Wu | |
| 7,605,707 | B2 | 10/2009 | German | |
| 7,622,682 | B2 | 11/2009 | Malin | |
| 7,648,392 | B2 | 1/2010 | Chambers et al. | |
| 7,654,831 | B1 * | 2/2010 | Wu | H01R 12/62 439/607.46 |
| 7,661,979 | B2 | 2/2010 | Hughes | |
| 7,789,718 | B2 | 9/2010 | Desard | |
| 7,841,889 | B2 * | 11/2010 | Gerard | H01R 13/6272 439/358 |
| 7,845,859 | B2 | 12/2010 | Roth et al. | |
| 8,212,145 | B2 | 7/2012 | Nagai | |
| 8,340,123 | B2 | 12/2012 | Barbieri | |
| 8,370,704 | B2 | 2/2013 | Ganga | |
| 8,506,176 | B2 | 8/2013 | Daikuhara | |
| 8,585,426 | B2 | 11/2013 | Zerebilov | |
| 8,596,882 | B2 | 12/2013 | Smrha et al. | |
| 8,636,544 | B1 | 1/2014 | Briant | |
| 8,639,082 | B2 | 1/2014 | Haley | |
| 8,645,747 | B2 | 2/2014 | Buckland | |
| 8,668,525 | B1 * | 3/2014 | Tu | H01R 43/18 439/488 |
| 8,770,990 | B2 * | 7/2014 | Sytsma | H01R 9/034 439/76.1 |
| 8,867,883 | B2 | 10/2014 | Crain | |
| 8,882,514 | B2 | 11/2014 | Enge | |
| 8,910,912 | B2 | 12/2014 | Child | |
| 8,926,339 | B2 * | 1/2015 | Houtz | H01R 13/5045 439/76.1 |
| 9,088,119 | B2 | 7/2015 | Baker | |
| 2004/0048506 | A1 | 3/2004 | Chung et al. | |
| 2004/0115997 | A1 | 6/2004 | Scherer | |
| 2005/0098688 | A1 | 5/2005 | Miarka | |
| 2005/0224585 | A1 | 10/2005 | Durrant | |
| 2005/0271328 | A1 | 12/2005 | Ohtsu | |
| 2006/0148279 | A1 | 7/2006 | German | |
| 2006/0189180 | A1 | 8/2006 | Lang | |
| 2007/0111598 | A1 | 5/2007 | Quilici | |
| 2007/0232132 | A1 | 10/2007 | Ling | |
| 2010/0062627 | A1 | 3/2010 | Ambo | |
| 2010/0065327 | A1 | 3/2010 | Lin | |
| 2010/0130063 | A1 | 5/2010 | Lang et al. | |
| 2011/0034082 | A1 | 2/2011 | Zhu | |
| 2011/0165785 | A1 | 7/2011 | Lindner | |
| 2011/0168423 | A1 | 7/2011 | Hagi | |
| 2011/0237112 | A1 | 9/2011 | Wu et al. | |
| 2011/0300735 | A1 | 12/2011 | Wu | |
| 2012/0129382 | A1 | 5/2012 | Regnier | |
| 2012/0251064 | A1 | 10/2012 | Crain | |
| 2013/0005173 | A1 | 1/2013 | Reed et al. | |
| 2013/0183846 | A1 | 7/2013 | Kappla et al. | |
| 2013/0231011 | A1 | 9/2013 | Sytsma | |
| 2014/0038447 | A1 | 2/2014 | Brown | |
| 2014/0041937 | A1 | 2/2014 | Lloyd et al. | |
| 2014/0205243 | A1 | 7/2014 | Baker | |
| 2014/0363171 | A1 | 12/2014 | Tang | |

FOREIGN PATENT DOCUMENTS

| | | |
|---|---|---|
| JP | 2009076375 | 4/2009 |
| KR | 1020100068002 | 6/2010 |
| TW | I267238 | 11/2006 |
| TW | M430018 | 5/2012 |
| WO | WO-2014043426 | 3/2014 |

OTHER PUBLICATIONS

"8 Channel Dula Multi-lane Sata2 Enclosure Device Bracket Scsi Opening," Retrieved from Internet Sep. 15, 2014, http://www/satacable.com/8-channel-dula-multi-lane-sata2-enclosure-device-bracket-scsi-opening.html.

Accessories for Retaining Helawrap Open Cable Cover HWCLIP08, 3 pages; Retrieved from Internet Sep. 1, 2015, <http://www.hellermanntyton.co.uk/site/products/protective-tubing-and-spiral-binding/hwclip08/161-64002 >.

Neer, et al.; "Advanced SAS Connections Converge at 3.0," Retrieved form Internet Sep. 15, 2014; 5 pages; http://www.serialstoragewire.net/Articles/2009_12/molex.html.

PCT/ISA/KR, International Search Report and Written Opinion, dated Nov. 11, 2015, PCT/US2015/016283, 9 pps.

PCT/ISA/KR, International Search Report and Written Opinion, dated Jun. 19, 2015, PCT/US2014/057858, 12 pps.

PCT/ISA/KR, International Search Report and Written Opinion, dated Nov. 20, 2015, PCT/US2015/017964, 10 pps.

PCT/ISA/KR, International Search Report and Written Opinion, dated Jan. 22, 2016, PCT/US2015/028277, 14 pp.

Dennis Martin, "Demartek Storage Networking Interface Comparison," May 9, 2014, http://www.demartek.com/Demartek_Interface_ Comparison.html.

"LC Right Angle Clip" Feb. 22, 2013, <http://www.senko.com/fiber/pdf_brochure/FeaturesBrochure_2013-v5.pdf >.

"8 Channel Dula Multi-lane Sata2 Enclosure Device Bracket Scsi Opening," Retrieved from Internet Sep. 15, 2014, http://www.satacable.com/8-channel.dula.multi-lane-sata2-enclosure-drvice-bracket-scsi.

* cited by examiner

MULTIPLE CABLE HOUSING ASSEMBLY

BACKGROUND

High-radix network switch modules may support a high number of connectors on their faceplates. Network port standards allow 1-lane and wider ports (e.g., 12-lane for CXP), and wider ports use larger connectors and thus fewer connectors on the faceplate. Different applications use different port bandwidth. Traditionally, either 1-lane (e.g., Small Form-Factor Pluggable (SFP)) or 4-lane (e.g., Quad Small Form-Factor Pluggable (QSFP)) ports and cables predominate the Ethernet industry. As the bandwidth per lane has reached 10 Gbps, however, not every system can take advantage of QSFP 4-lane cables.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

A 4-lane cable assembly with a 4-lane connector may fan-out to four 1-lane cables and corresponding connectors on the other end of a break-out cable assembly. Similarly, a 2-lane break-out cable assembly has a 2-lane cable connector at one end and two 1-lane cable connectors at the other end of the break-out cable assembly. Attaching wires from a 4-lane cable to four 1-lane connector boards within a 4-lane cable connector housing uses a connector housing having a large back-end to accommodate the routing of the wires from the cable to each connector board. Similarly, attaching wires from a 2-lane cable to two 1-lane connector boards within a 2-lane cable connector housing uses a connector housing having a large back-end to accommodate the routing of the wires from the cable to each connector board. In addition, high-speed signal crosstalk may be present in the large back-end of a 4-lane or 2-lane cable connector housing when a short portion of the differential pair wires coupled to the connector boards are exposed within the housing.

Accordingly, examples as disclosed herein provide cable assemblies having relatively short connector housings that isolate electrical crosstalk among the high-speed differential pair wires within the connector housings. The example connector housings are coupled to a 1-lane cable for each connector board within the housing. Accordingly, a 4-lane cable assembly includes a 4-lane connector housing supporting four connector boards and four 1-lane cables with each cable electrically coupled to a respective connector board. Likewise, a 2-lane cable assembly includes a 2-lane connector housing supporting two connector boards and two 1-lane cables with each cable electrically coupled to a respective connector board.

Figure 1:
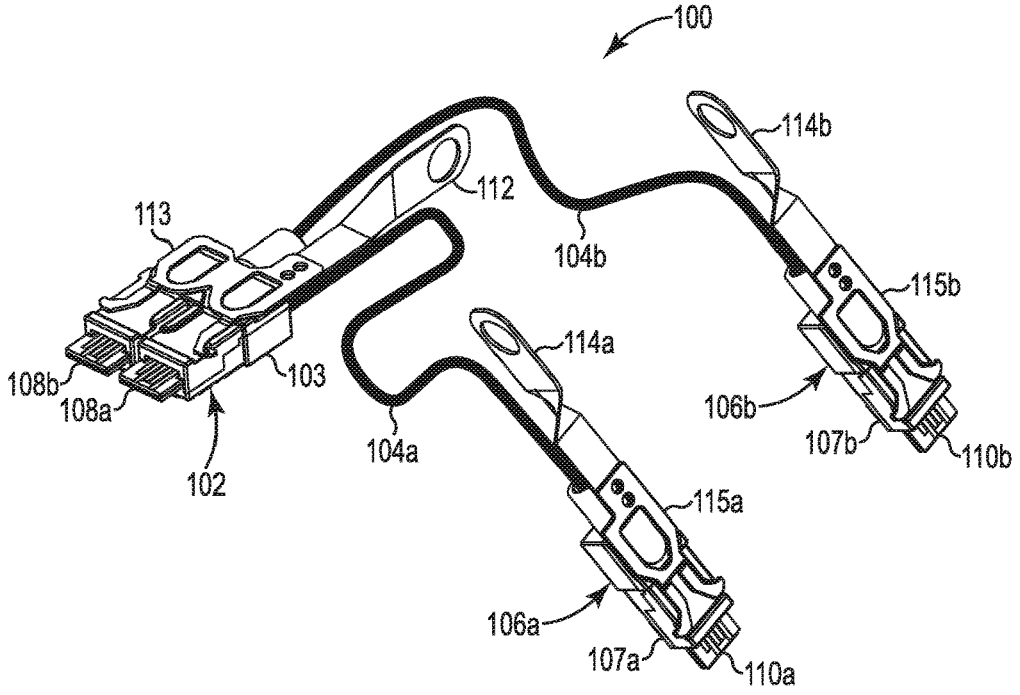
FIG. 1 illustrates one example of a 2-lane cable assembly.

FIG. 1 illustrates one example of a 2-lane cable assembly 100. The 2-lane cable assembly 100 includes a 2-lane cable connector 102, two 1-lane cables 104*a* and 104*b*, and two 1-lane cable connectors 106*a* and 106*b*. The 2-lane cable connector 102 includes a 2-lane connector housing 103, two connector boards 108*a* and 108*b* partially enclosed within connector housing 103, and a latching mechanism 113 for installing cable connector 102 to, and a pull-tab mechanism 112 for removing cable connector 102 from a corresponding 2-lane receptacle. The 1-lane cable connector 106*a* includes a 1-lane connector housing 107*a*, a connector board 110*a*, and a latching mechanism 115*a* for installing cable connector 106*a* to, and a pull-tab mechanism 114*a* for removing cable connector 106*a* from a corresponding 1-lane receptacle. The 1-lane cable connector 106*b* includes a 1-lane connector housing 107*b*, a connector board 110*b*, and a latching mechanism 115*b* for installing cable connector 106*b* to, and a pull-tab mechanism 114*b* for removing cable connector 106*b* from a corresponding 1-lane receptacle.

The 1-lane cable 104*a* is electrically coupled on one end to connector board 108*a* within connector housing 103 of cable connector 102 and at the other end to connector board 110*a* within connector housing 107*a* of cable connector 106*a*. The 1-lane cable 104*b* is electrically coupled on one end to connector board 108*b* within connector housing 103 of cable connector 102 and at the other end to connector board 110*b* within connector housing 107*b* of cable connector 106*b*. By having individual 1-lane cables directly connected to 2-lane cable connector 102, connector housing 103 may have a shorter back-end where cables 104*a* and 104*b* are electrically coupled to connector boards 108*a* and 108*b*, respectively.

Figure 2:
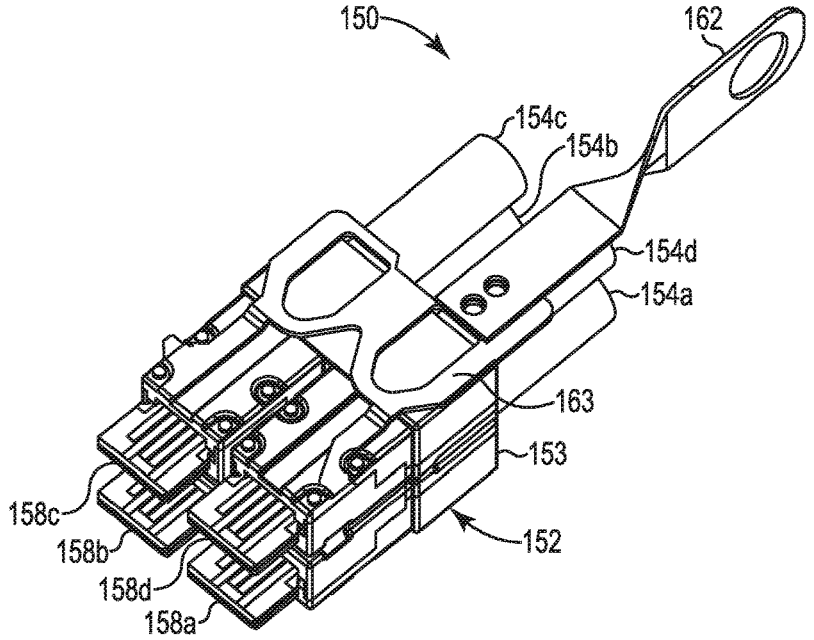
FIG. 2 illustrates one example of a 4-lane cable assembly.

FIG. 2 illustrates one example of a 4-lane cable assembly 150. The 4-lane cable assembly 150 includes a 4-lane cable connector 152, four 1-lane cables 154*a*, 154*b*, 154*c*, and 154*d*, and corresponding four 1-lane cable connectors (not shown). The 4-lane cable connector 152 includes a 4-lane connector housing 153, four connector boards 158*a*, 158*b*, 158*c*, and 158*d* partially enclosed within connector housing 153, and a latching mechanism 163 for installing cable connector 152 to, and a pull-tab mechanism 162 for removing cable connector 152 from a corresponding 4-lane receptacle.

The 1-lane cable 154*a* is electrically coupled on one end to connector board 158*a* within connector housing 153 of cable connector 152 and at the other end to a first 1-lane cable connector as previously described and illustrated with reference to FIG. 1. The 1-lane cable 154*b* is electrically coupled on one end to connector board 158*b* within connector housing 153 of cable connector 152 and at the other end to a second 1-lane cable connector. The 1-lane cable

154*c* is electrically coupled on one end to connector board 158*c* within connector housing 153 of cable connector 152 and at the other end to a third 1-lane cable connector. The 1-lane cable 154*d* is electrically coupled on one end to connector board 158*d* within connector housing 153 of cable connector 152 and at the other end to a fourth 1-lane cable connector. By having individual 1-lane cables directly connected to 4-lane cable connector 152, connector housing 153 may have a shorter back-end where cables 154*a*, 154*b*, 153*c*, and 154*d* are electrically coupled to connector boards 158*a*, 158*b*, 158*c*, and 158*d*, respectively.

Figure 3B:
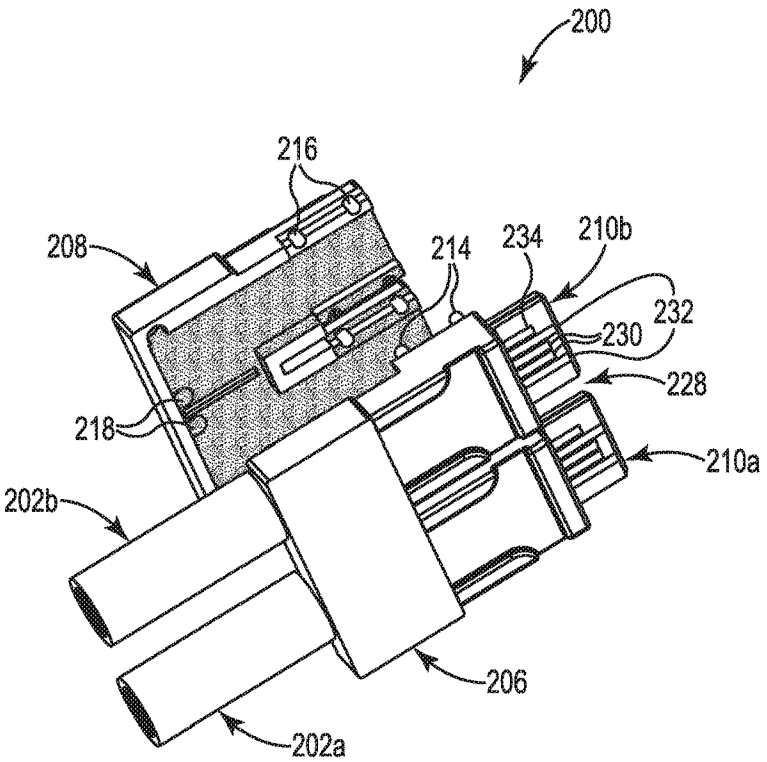
FIGS. 3A and 3B illustrate different views of one example of a 2-lane cable assembly having a dielectric material housing.
Figure 3A:
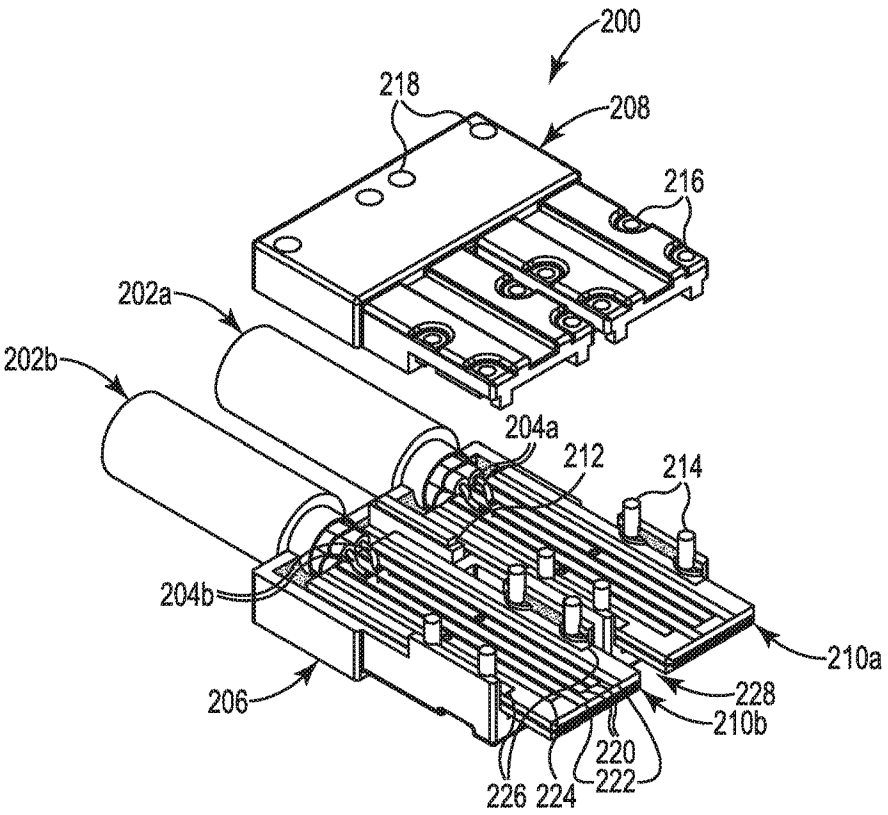

FIGS. 3A and 3B illustrate different views of one example of a 2-lane cable assembly 200 having a dielectric material housing. FIG. 3A illustrates a top exploded view and FIG. 3B illustrates a bottom exploded view of 2-lane cable assembly 200. The 2-lane cable assembly 200 includes a 2-lane cable connector and two 1-lane cables 202*a* and 202*b*. The 2-lane cable connector includes two connector boards 210*a* and 210*b* and a 2-lane connector housing including a housing base 206 and a housing lid 208.

Each 1-lane cable 202*a* and 202*b* may include a first differential pair of wires for transmit signals and a second differential pair of wires for receive signals (e.g., differential pair of wires 204*a* for cable 202*a* and differential pair of wires 204*b* for cable 202*b* as visible in FIG. 3A). Each 1-lane cable 202*a* and 202*b* may also include at least one drain wire and power and/or management signal wires.

Each connector board 210*a* and 210*b* includes a plurality of conductive traces, which will be described with reference to connector board 210*b*. In one example, an embedded ground layer (not visible) may be included within connector board 210*b*. As illustrated in FIG. 3A, one side of connector board 210*b* includes a first pair of signal traces 220, a first pair of ground traces 222, a power or management signal trace 224, and a first pair of housing connection traces 226. As illustrated in FIG. 3B, the other side of connector board 210*b* includes a second pair of signal traces 230, a second pair of ground traces 232, a power or management signal trace 234, and a second pair of housing connection traces (not visible). Ground traces 222 and 232 may be electrically coupled to the ground layer of connector board 210*b*.

The first pair of signal traces 220 are electrically coupled to differential pair of wires 204*b* of cable 202*b*, and the second pair of signal traces 230 are electrically coupled to the other differential pair of wires of cable 202*b* (not visible). In one example, at least one of the ground traces 202 and/or 232 may be electrically coupled to a drain wire of cable 202*b*. In one example, at least one of the power or management signal traces 224 and/or 234 may be electrically coupled to a power or management signal wire of cable 202*b*. In another example, management signal traces 224 and/or 234 may be electrically coupled, directly or via a resistor component (not shown), to the ground layer of connector board 210*b*. The housing connection traces (e.g., 226), which electrically contact housing base 206 and/or housing lid 208, may also be electrically coupled to the ground layer of connector board 210*b*.

In this example, housing base 206 and housing lid 208 are made of a dielectric material and the inner surfaces of housing base 206 and housing lid 208 are coated with a Radio Frequency Interference (RFI)/Electromagnetic Interference (EMI) shielding material (e.g., a metallic material) as indicated by the stippling in FIGS. 3A and 3B. The assembled housing including housing base 206 and housing lid 208 is partly U-shaped such that a portion of connector board 210*a* is isolated from a portion of connector board 210*b* by an air gap 228.

The assembled housing also includes an isolation plate 212 in the back-end of the housing to isolate the remaining portion of connector board 210*a* from the remaining portion of connector board 210*b*. Isolation plate 212 comprises a metallic material and prevents crosstalk between the differential pairs of wires of cables 202*a* and 202*b* in the back-end of the housing. Isolation plate 212 may be an insertable and removable part of housing base 206 or an integral part of housing base 206 and/or housing lid 208. In one example, with isolation plate 212 installed in the assembled housing, isolation plate 212 electrically contacts housing base 206 and housing lid 208. Housing base 206 and housing lid 208 electrically contact housing connection traces 226, which are electrically coupled to the ground layer of connector boards 210*a* and 210*b*. Thus, a fully shielded housing for connector boards 210*a* and 210*b* is provided.

Housing base 206 supports connector boards 210*a* and 210*b*, Housing base 206 may include pins 214, which have bases that extend into notches in the sides of connectors boards 210*a* and 210*b* to secure the connector boards within housing base 206. Housing lid 208 includes openings 216 corresponding to pins 214 to align and couple housing lid 208 to housing base 206. In one example, housing lid 208 is press fit to housing base 206 to provide the assembled housing. In another example, housing lid 208 includes openings 218 for attaching housing lid 208 to housing base 206 via screws or other suitable fasteners. In other examples, housing lid 208 may be attached to housing base 206 in another suitable manner, such as via an adhesive, welding, or riveting.

Figure 4B:
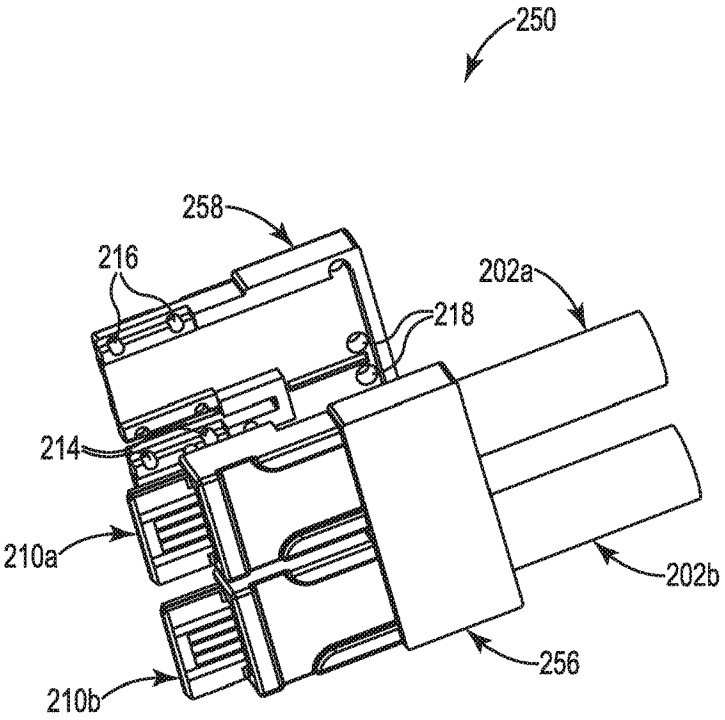
FIGS. 4A-4C illustrate different views of one example of a 2-lane cable assembly having a metallic material housing.
Figure 4A:
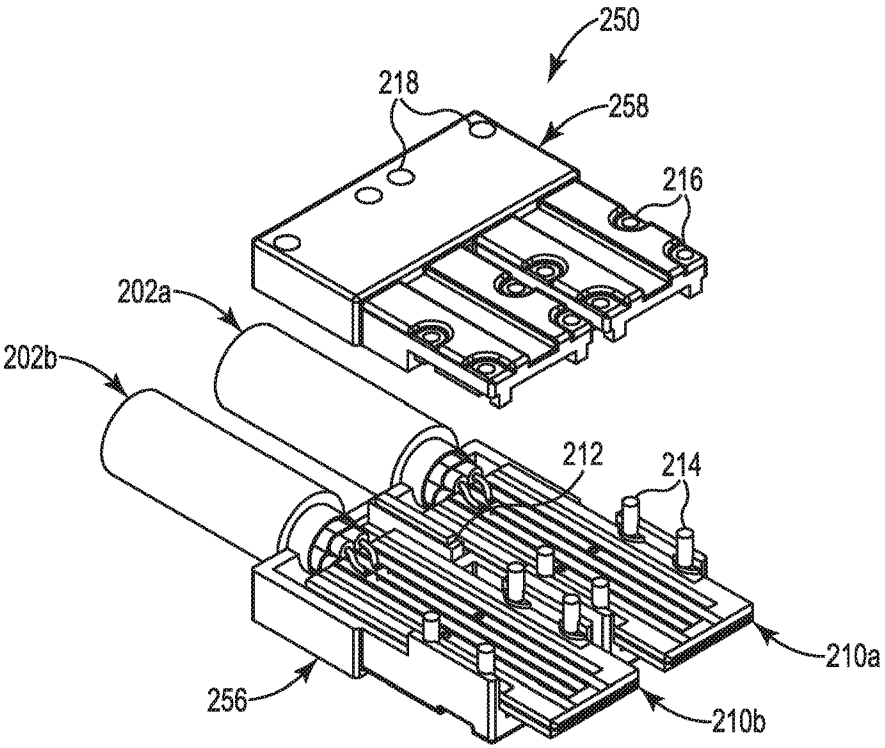
Figure 4C:
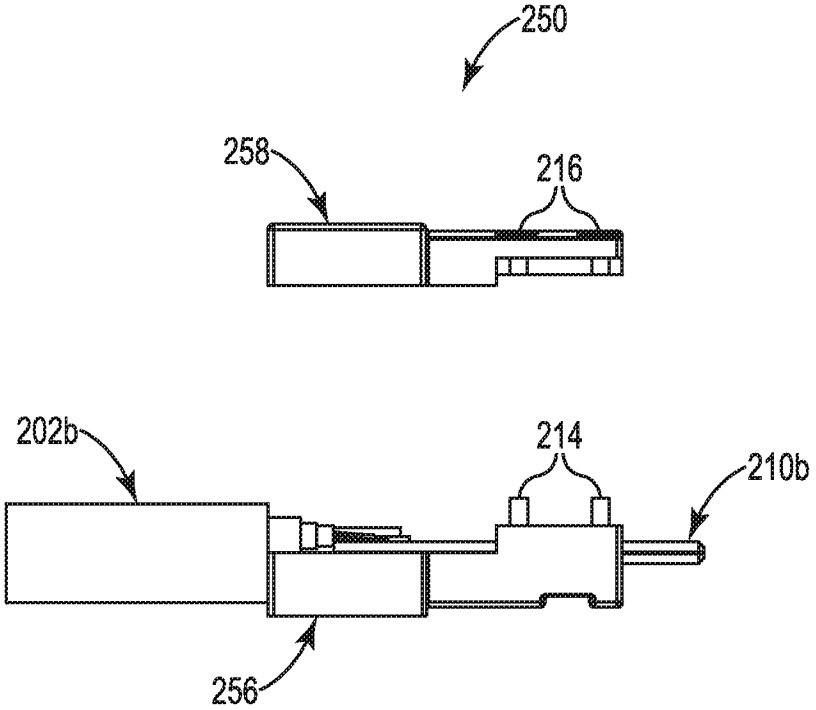

FIGS. 4A-4C illustrate different views of one example of a 2-lane cable assembly 250 having a metallic material housing. FIG. 4A illustrates a top exploded view, FIG. 4B illustrates a bottom exploded view, and FIG. 4C illustrate a side exploded view of 2-lane cable assembly 250. The 2-lane cable assembly 250 includes a 2-lane cable connector and two 1-lane cables 202*a* and 202*b*. The 2-lane cable connector includes two connector boards 210*a* and 210*b* and a 2-lane connector housing including a housing base 256 and a housing lid 258.

The 1-lane cables 202*a* and 202*b* and the connector boards 210*a* and 210*b* have been previously described with reference to FIGS. 3A and 3B. In this example, however, housing base 256 and housing lid 258 are made of a metallic material that provides RFI/EMI shielding and isolation plate 212 is an integral part of housing base 256 and/or housing lid 258. Housing base 256 includes pins 214 and housing lid 258 includes openings 216 and 218 for attaching the housing lid to the housing base as previously described with reference to FIGS. 3A and 3B.

Figure 5B:
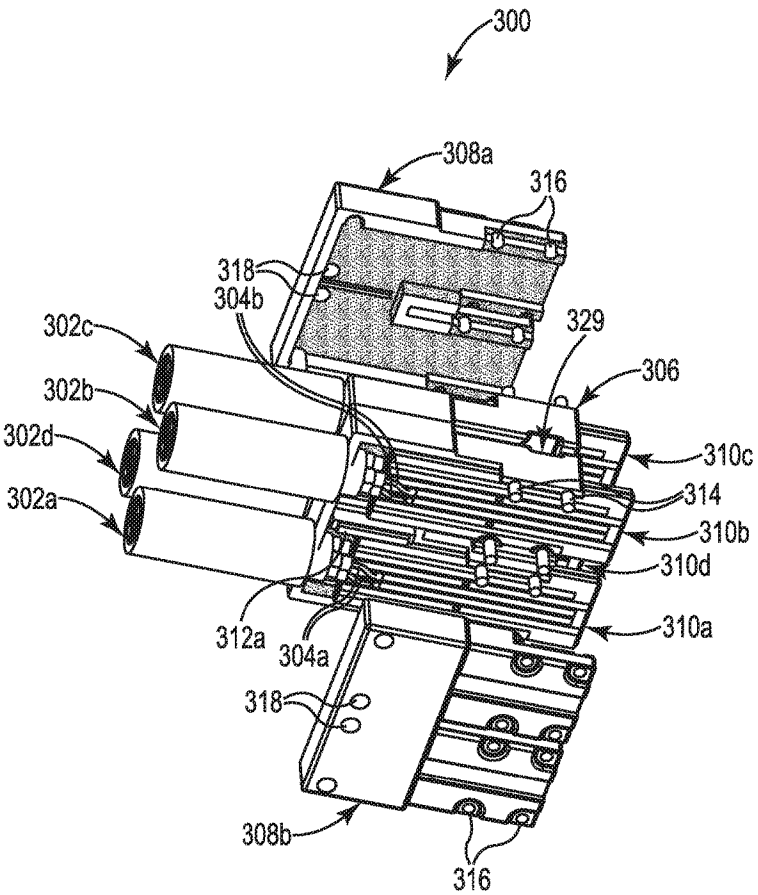
FIGS. 5A-5D illustrate different views of one example of a 4-lane cable assembly having a dielectric material housing.
Figure 5A:
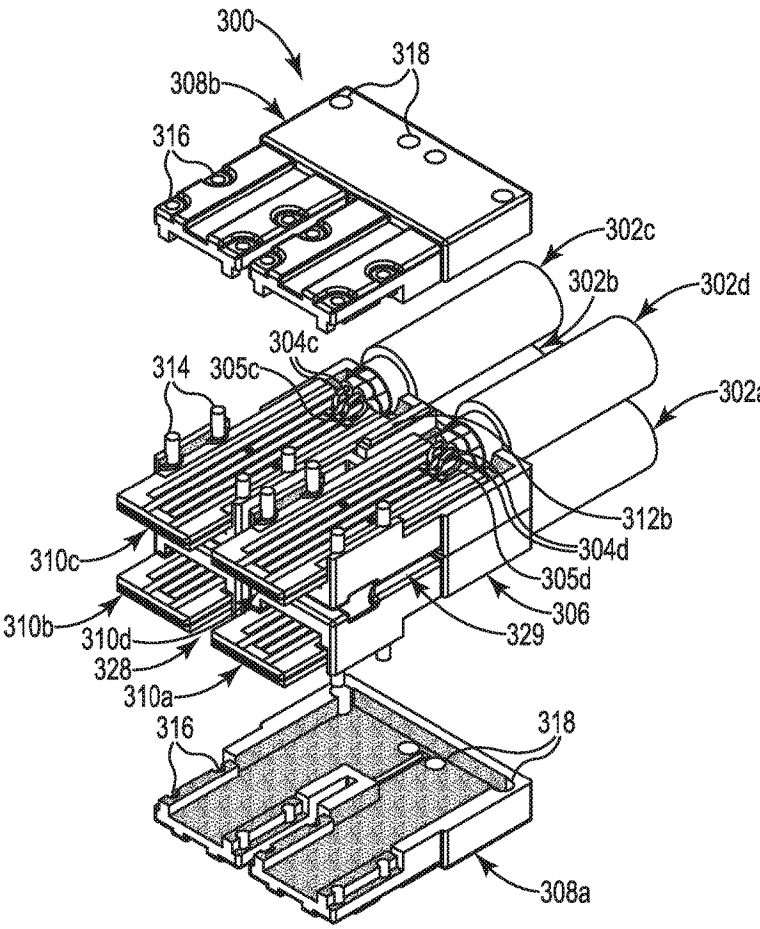
Figure 5D:
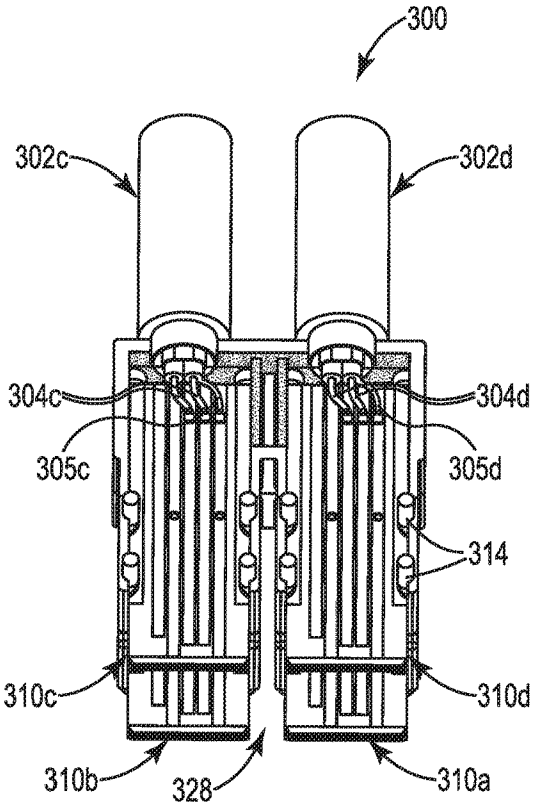
Figure 5C:
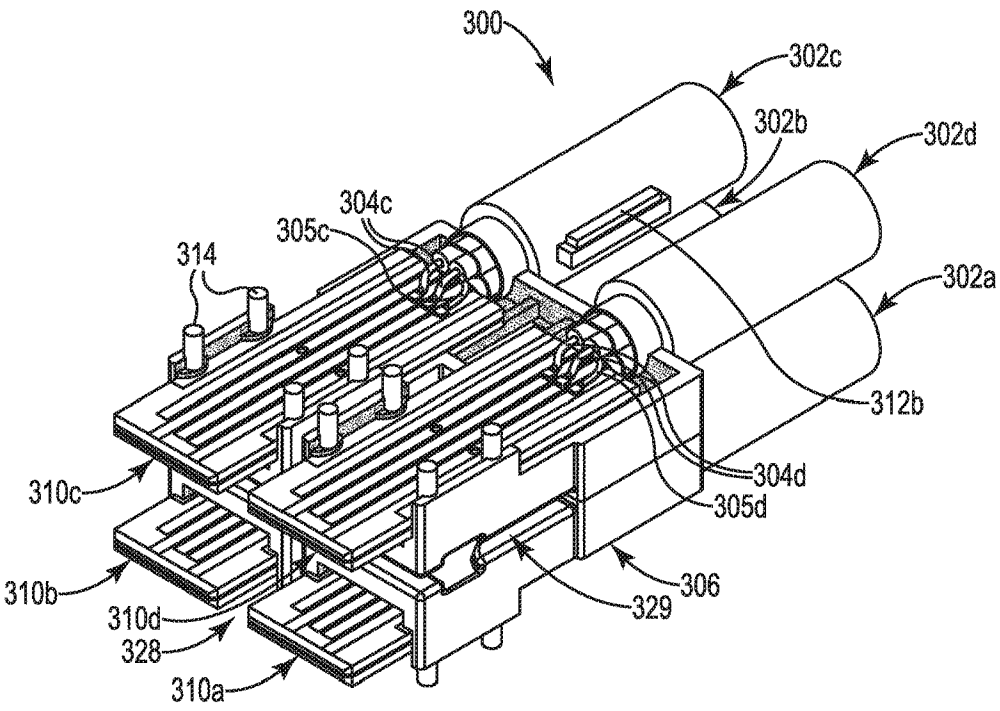

FIGS. 5A-5D illustrate different views of one example of a 4-lane cable assembly 300 having a dielectric material housing. FIG. 5A illustrates a top exploded view with an installed isolation plate, FIG. 5B illustrates a bottom exploded view with an installed isolation plate, FIG. 5C illustrates a top exploded view of a housing base and isolation plate 312*b*, and FIG. 5D illustrates a top view of a housing base without an isolation plate for 4-lane cable assembly 300. The 4-lane cable assembly 300 includes a 4-lane cable connector and four 1-lane cables 302*a*, 302*b*, 302*c*, and 302*d*. The 4-lane cable connector includes four connector boards 310*a*, 310*b*, 310*c*, and 310*d* and a 4-lane connector housing including a housing base 306, a first housing lid 308*a*, and a second housing lid 308*b*.

Each 1-lane cable 302*a*, 302*b*, 302*c*, and 302*d* includes a first differential pair of wires for transmit signals and a second differential pair of wires for receive signals (e.g., differential pair of wires 304*a* for cable 302*a* and differential pair of wires 304*b* for cable 302*b* visible in FIG. 5B, and differential pair of wires 304*c* for cable 302*c* and differential pair of wires 304*d* for cable 302*d* visible in FIGS. 5A, 5C, and 5D). Each 1-lane cable 302*a*, 302*b*, 302*c*, and 302*d* may also include at least one drain wire (e.g., drain wire 305*c* for cable 302*c* and drain wire 305*d* for cable 302*d* visible in FIGS. 5A, 5C, and 5D) and power and/or management signal wires.

Each connector board 310*a*, 310*b*, 310*c*, and 310*d* includes a plurality of conductive traces on each side of each connector board as previously described with reference to FIGS. 3A and 3B. As illustrated in FIGS. 5A, 5C, and 5D, drain wire 305*c* may be electrically coupled to a ground trace of connector board 310*c* and drain wire 305*d* may be electrically coupled to a ground trace of connector board 310*d*. The housing connection traces of each connector board may electrically contact housing base 306 and/or housing lid 308*a* or 308*b*.

In this example, housing base 306 and each housing lid 308*a* and 308*b* are made of a dielectric material and the inner surfaces of housing base 306 and each housing lid 308*a* and 308*b* are coated with a RFI/EMI shielding material (e.g., a metallic material) as indicated by the stippling in FIGS. 5A-5D. The assembled housing including housing base 306 and housing lids 308*a* and 308*b* is partly U-shaped such that a portion of connector board 310*a* is isolated from a portion of connector board 310*b* by an air gap 328, and a portion of connector board 310*c* is isolated from a portion of connector board 310*d* by the air gap 328. In addition, a portion of connector board 310*a* is isolated from a portion of connector board 310*d* by an air gap 329, and a portion of connector board 310*b* is isolated from a portion of connector board 310*c* by the air gap 329.

The assembled housing also includes a first isolation plate 312*a* in the back-end of the housing to isolate the remaining portion of connector board 310*a* from the remaining portion of connector board 310*b* as visible in FIG. 5B, and a second isolation plate 312*b* in the back-end of the housing to isolate the remaining portion of connector board 310*c* from the remaining portion of connector board 310*d* as visible in FIG. 5A. Isolation plate 312*a* comprises a metallic material and prevents crosstalk between the differential pairs of wires of cables 302*a* and 302*b* in the back-end of the housing. Isolation plate 312*b* comprises a metallic material and prevents crosstalk between the differential pairs of wires of cables 302*c* and 302*d* in the back-end of the housing. Isolation plates 312*a* and 312*b* may be insertable and removable parts of housing base 306 (as illustrated in FIG. 5C) or integral parts of housing base 306 and/or housing lids 308*a* and 308*b*. In addition, housing base 306 isolates connector board 310*a* from connector board 310*d* and isolates connector board 310*b* from connector board 310*c* in the back-end of housing base 306.

Housing base 306 supports connector boards 310*a* and 310*b* on a first side of the housing base and connector boards 310*c* and 310*d* on a second side of the housing base opposite to the first side. Housing base 306 may include pins 314, which have bases that extend into notches in the sides of connectors boards 310*a*, 310*b*, 310*c*, and 310*d* to secure the connector boards within housing base 306. Housing lids 308*a* and 308*b* include openings 316 corresponding to pins 314 to align and couple housing lids 308*a* and 308*b* to housing base 306, In one example, housing lids 308*a* and 308*b* are press fit to opposite sides of housing base 306 to provide the assembled housing. In another example, housing lids 308*a* and 308*b* includes openings 318 for attaching housing lids 308*a* and 308*b* to opposite sides of housing base 306 via screws or other suitable fasteners. In other examples, housing lids 308*a* and 308*b* may be attached to opposite sides of housing base 306 in another suitable manner, such as via an adhesive, welding, or riveting.

Figure 6B:
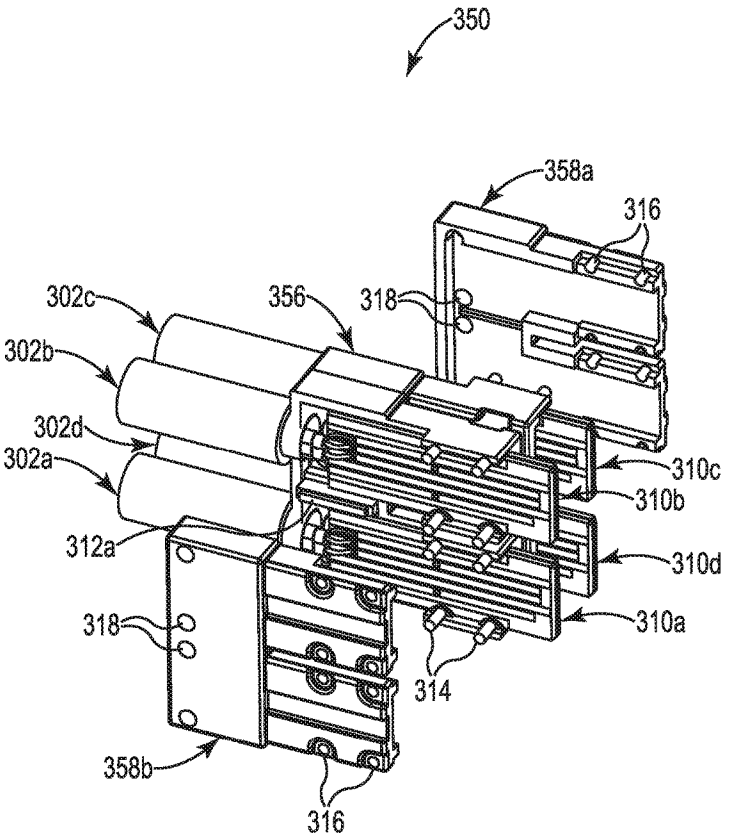
FIGS. 6A-6D illustrate different views of one example of a 4-lane cable assembly having a metallic material housing.
Figure 6A:
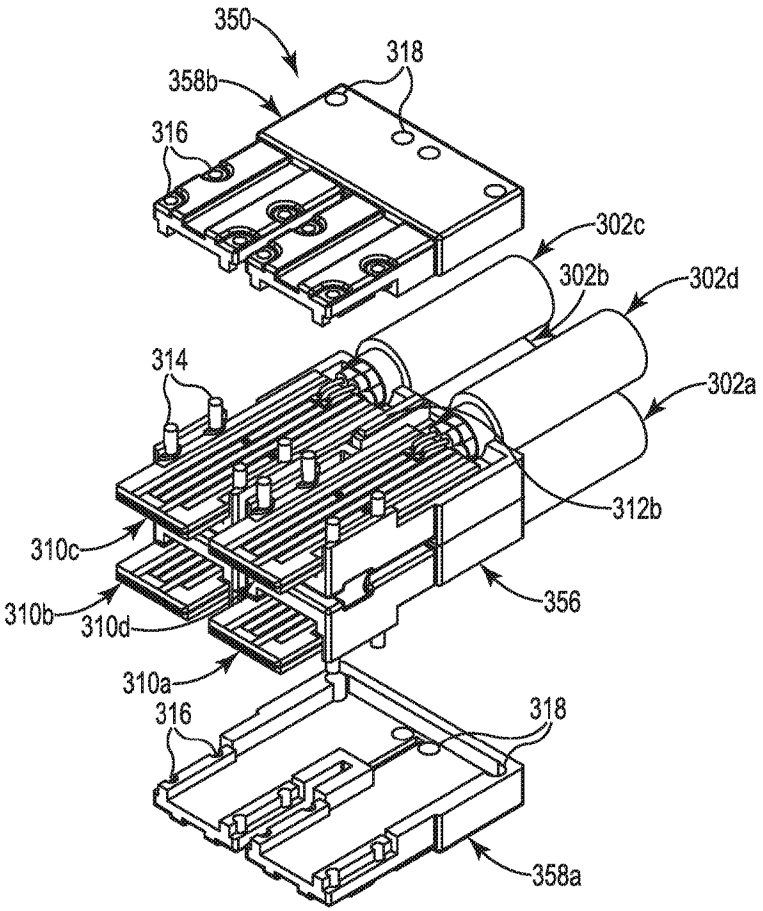
Figure 6D:
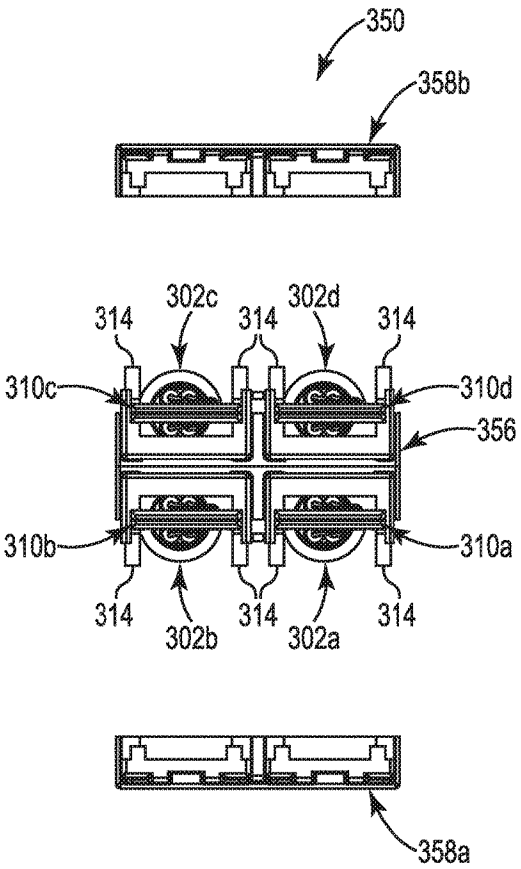
Figure 6C:
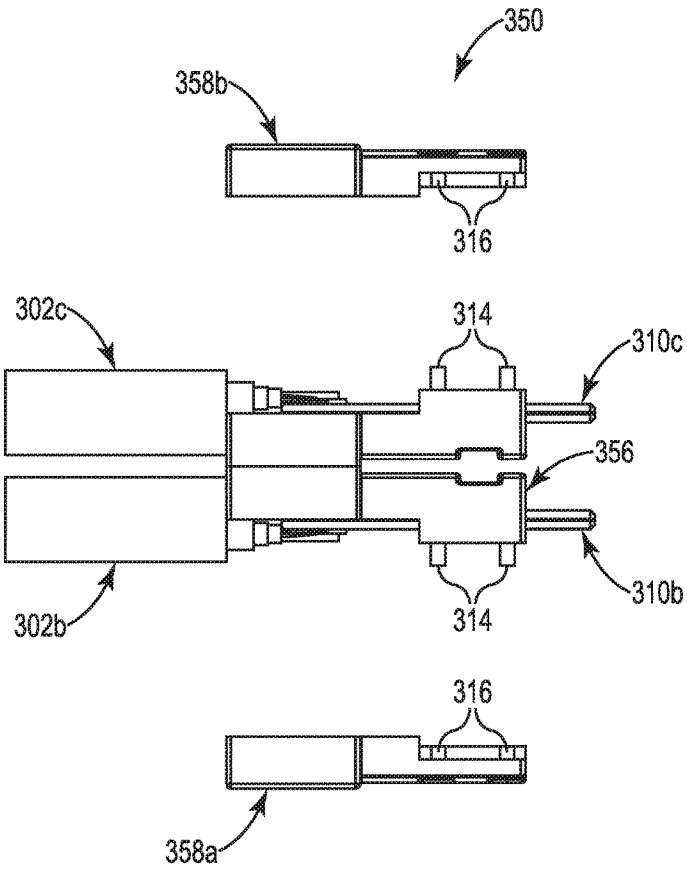

FIGS. 6A-6D illustrate different views of one example of a 4-lane cable assembly 350 having a metallic material housing. FIG. 6A illustrates a top exploded view, FIG. 6B illustrates a bottom exploded view, FIG. 6C illustrates a side exploded view, and FIG. 6D illustrate a front exploded view of 4-lane cable assembly 350. The 4-lane cable assembly 350 includes a 4-lane cable connector and four 1-lane cables 302*a*, 302*b*, 302*c*, and 302*d*. The 4-lane cable connector includes four connector boards 310*a*, 310*b*, 310*c*, and 310*d* and a 4-lane connector housing including a housing base 356, a first housing lid 358*a*, and a second housing lid 358*b*.

The 1-lane cables 302*a*, 302*b*, 302*c*, and 302*d* and the connector boards 310*a*, 310*b*, 310*c*, and 310*d* have been previously described with reference to FIGS. 5A-5D. In this example, however, housing base 356 and housing lids 358*a* and 358*b* are made of a metallic material that provides RFI/EMI shielding and isolation plates 312*a* and 312*b* are integral parts of housing base 356 and/or housing lids 358*a* and 358*b*. Housing base 356 includes pins 314 and housing lids 358*a* and 358*b* include openings 316 and 318 for attaching the housing lids to opposite sides of the housing base as previously described with reference to FIGS. 5A-5D.

Figure 7A:
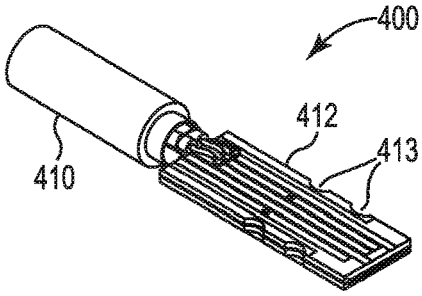
FIGS. 7A-7D illustrate different parts of a modular cable assembly system.

FIGS. 7A-7D illustrate different parts of a modular cable assembly system, FIG. 7A illustrates one example of a cable part 400. Cable part 400 includes a cable 410 terminated to a connector board 412 on at least one end of the cable 410. In one example, connector board 412 includes notches 413 in the sides of the connector board for securing the connector board within a housing.

Figure 7B:
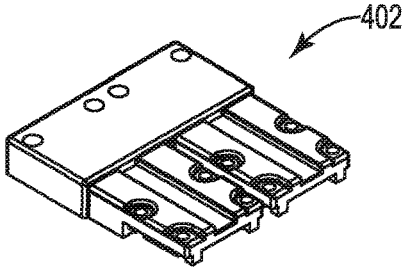

FIG. 7B illustrates one example of a housing lid part 402. Housing lid part 402 may be made of a metallic material or may be made of a dielectric material with the inner surfaces of the housing lid part coated with a metallic material.

Figure 7C:
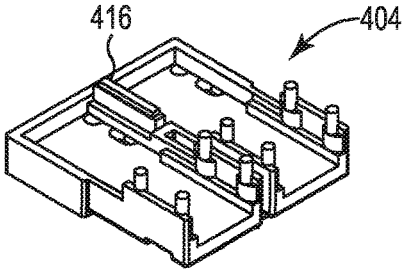

FIG. 7C illustrates one example of a first housing base part 404. First housing base part 404 may be made of a metallic material or may be made of a dielectric material with the inner surfaces of the first housing base part coated with a metallic material. First housing base part 404 may support two connector boards 412 of cable parts 400 and one housing lid part 402.

Figure 7D:
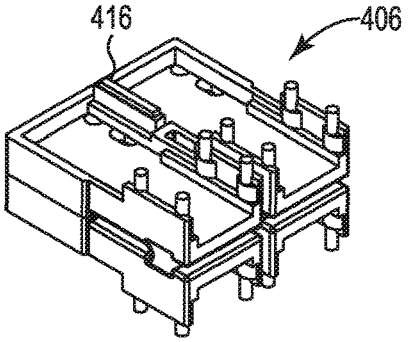

FIG. 7D illustrates a second housing base part 406. Second housing base part 406 may be made of a metallic material or may be made of a dielectric material with the inner surfaces of the second housing base part coated with a metallic material. Second housing base part 406 has a first side and a second side opposite to the first side. Second housing base part 406 may support a first two connector boards 412 of cable parts 400 and a first housing lid part 402 on the first side. Second housing base part 406 may support a second two connector boards 412 of cables parts 400 and a second housing lid part 402 on the second side.

Using cable part 400, housing lid part 402, first housing base part 404, and second housing base part 406, a 2-lane cable assembly as previously described and illustrated with reference to FIGS. 3A-4C or a 4-lane cable assembly as previously described and illustrated with reference to FIGS. 5*a*-6D may be fabricated. A 2-lane cable assembly may be fabricated with one first housing base part 404, one housing lid part 402, and two cable parts 400. A 4-lane cable assembly may be fabricated with one second housing base part 406, two housing lid parts 402, and four cable parts 400.

In other examples, the modular cable assembly system also includes an isolation plate part 416. In this case, a 2-lane cable assembly is further fabricated with one isolation plate part 416 within the first housing base part 404 between the two connector boards. A 4-lane cable assembly is further fabricated with two isolation plate parts 416, one of the isolation plate parts within the first side of the second housing base part between the two connector boards in the first side of the second housing base part and the other one of the isolation plate parts within the second side of the second housing base part between the two connector boards in the second side of the second housing base part. The modular cable assembly system illustrated in FIGS. 7A-7D may enable lower part costs by using the same cable part for 1-lane, 2-lane, and 4-lane cable assemblies and the same housing lid part for 2-lane and 4-lane cable assemblies.

Figure 8A:
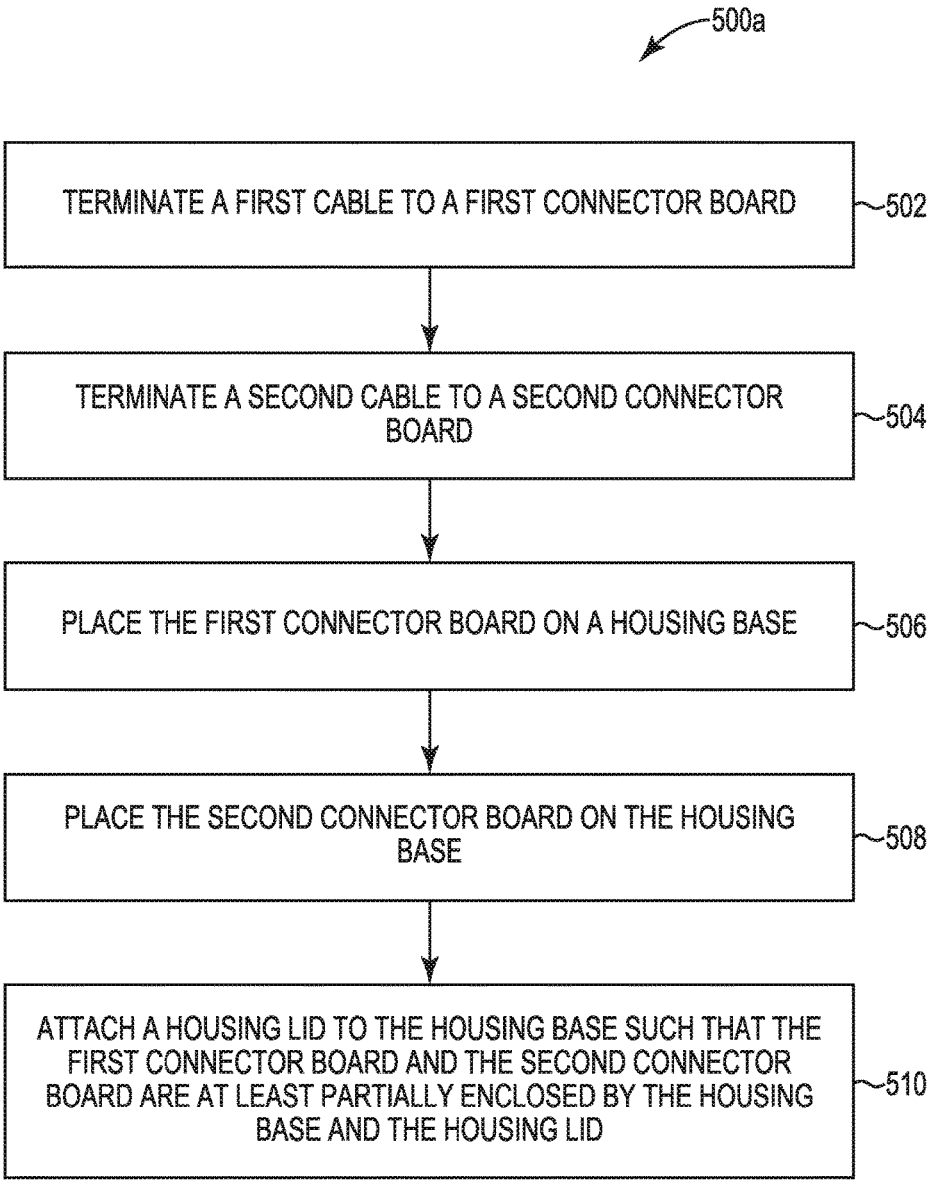
FIGS. 8A-8B illustrate one example of a method for fabricating a cable assembly.

FIG. 8A illustrates one example of a method 500*a* for fabricating a cable assembly, such as a 2-lane cable assembly. At 502, a first cable is terminated to a first connector board. At 504, a second cable is terminated to a second connector board. At 506, the first connector board is placed on a housing base. At 508, the second connector board is placed on the housing base. At 510, a housing lid is attached to the housing base such that the first connector board and the second connector board are at least partially enclosed by the housing base and the housing lid.

Figure 8B:
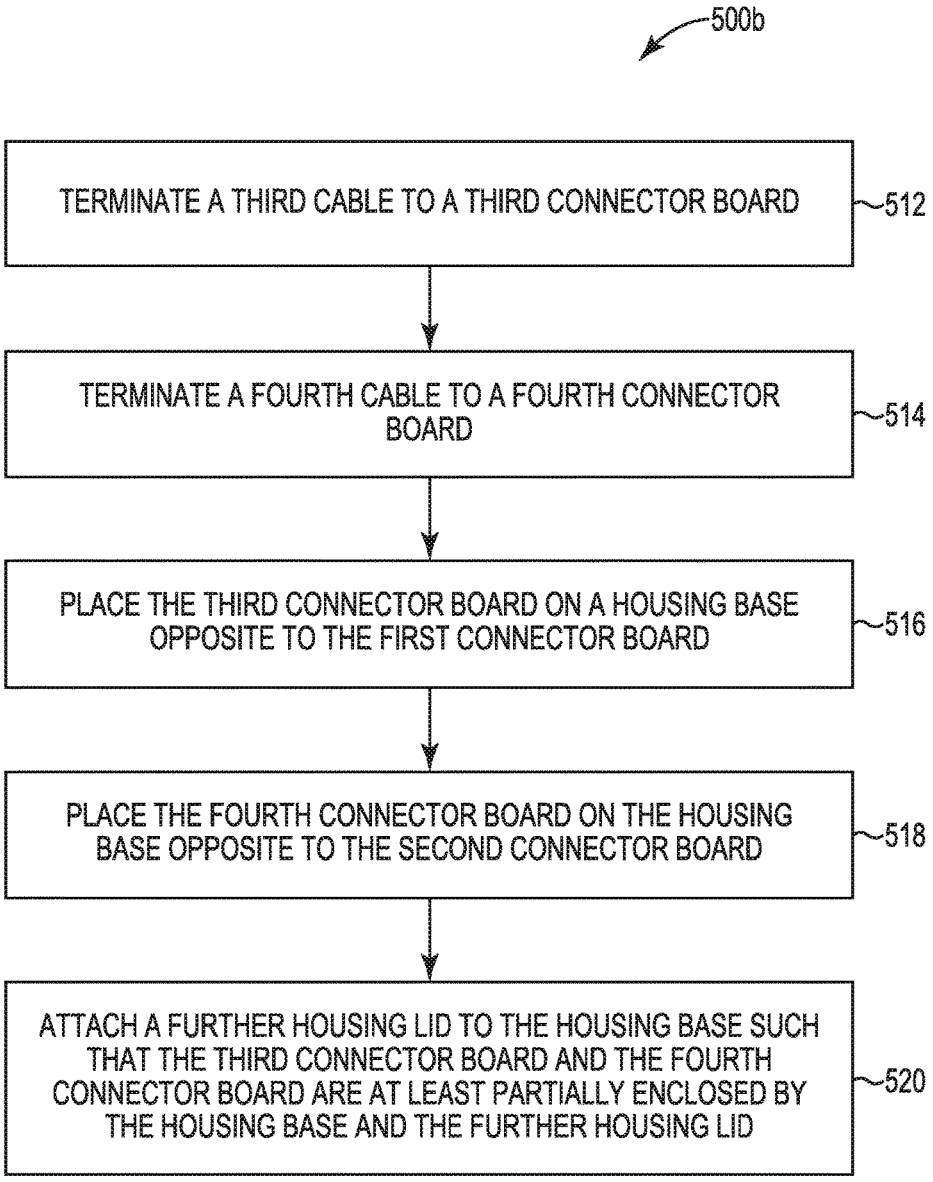

FIG. 8B illustrates one example of a method 500*b*, which is a continuation of method 500*a* previously described and illustrated with reference to FIG. 8A, for fabricating a cable assembly, such as a 4-lane cable assembly. At 512, a third cable is terminated to a third connector board. At 514, a fourth cable is terminated to a fourth connector board. At 516, the third connector board is placed on the housing base opposite to the first connector board. At 518, the fourth connector board is placed on the housing base opposite to the second connector board. At 520, a further housing lid is attached to the housing base such that the third connector board and the fourth connector board are at least partially enclosed by the housing base and the further housing lid.

In one example, method 500*a* may also include placing an isolation plate on the housing base between the first connector board and the second connector board prior to attaching the housing lid. Method 500*b* may also include placing a further isolation plate on the housing base between the third connector board and the fourth connector board prior to attaching the further housing lid.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A cable assembly comprising:
- a housing;
- a first cable;
- a first connector board electrically coupled to the first cable and at least partially arranged within the housing;
- a second cable;
- a second connector board electrically coupled to the second cable and at least partially arranged within the housing
- a third cable;
- a third connector board electrically coupled to the third cable and at least partially arranged within the housing;
- a fourth cable; and
- a fourth connector board electrically coupled to the fourth cable and at least partially arranged within the housing,
- wherein the first cable, the second cable, the third cable, and the fourth cable each include a latching mechanism to install each cable into the housing and a pull-tab mechanism to remove each from the housing.

2. The cable assembly of claim 1, further comprising:
- a first isolation plate arranged within the housing between the first connector board and the second connector board.

3. The cable assembly of claim 2, further comprising:
- a second isolation plate arranged within the housing between the third connector board and the fourth connector board.

4. The cable assembly of claim 1, wherein a part of the housing is U-shaped such that the first connector board is isolated from the second connector board by an air gap and the third connector board is isolated from the fourth connector board by an air gap.

5. The cable assembly of claim 1, wherein the housing comprises a dielectric material and an inner surface of the housing is coated with a metallic material to provide radio frequency interference shielding and electromagnetic interference shielding for the first connector board, the second connector board, the third connector board, and the fourth connector board.

6. The cable assembly of claim 1, wherein the housing comprises a metallic material to provide radio frequency interference shielding and electromagnetic interference shielding for the first connector board, the second connector board, the third connector board, and the fourth connector board and to prevent crosstalk between the first cable, the second cable, the third connector board, and the fourth connector board within the housing.

7. The cable assembly of claim 1, wherein the first cable, the second cable, the third cable, and the fourth cable are each 1-lane cables.

8. A modular cable assembly system comprising:
- a cable part comprising a cable terminated to a connector board on at least one end of the cable;
- a housing lid part;
- a first housing base part to support two connector boards and one housing lid part; and
- a second housing base part having a first side and a second side opposite to the first side, the second housing base part to support a first two connector boards and a first housing lid part on the first side and a second two connector boards and a second housing lid part on the second side,
- wherein a two lane cable assembly is fabricated with one first housing base part, one housing lid part, and two cable parts, and
- wherein a four lane cable assembly is fabricated with one second housing base part, two housing lid parts, and four cable parts.

9. The modular cable assembly system of claim 8, further comprising:
- an isolation plate part;
- wherein a two lane cable assembly is further fabricated with one isolation plate part within the first housing base part between the two connector boards, and
- wherein a four lane cable assembly is further fabricated with two isolation plate parts, one of the isolation plate parts within the first side of the second housing base part between the two connector boards in the first side of the second housing base part and the other one of the isolation plate parts within the second side of the second housing base part between the two connector boards in the second side of the second housing base part.

10. The modular cable assembly system of claim 8, wherein the cable of the cable part comprises a first differential pair of signal wires, a second differential pair of signal wires, and at least one drain wire.

11. The modular cable assembly system of claim 8, wherein the connector board of the cable part comprises a first pair of signal traces coupled to a first pair of wires of the cable and a second pair of signal traces coupled to a second pair of wires of the cable, the first pair of signal traces on a first side of the connector board and the second pair of signal traces on a second side of the connector board opposite to the first side of the connector board.

12. The modular cable assembly system of claim 8, wherein the connector board of the cable part comprises conductive traces that electrically contact a housing lid part once assembled into a two lane cable assembly or a four lane cable assembly.

13. A method for fabricating a cable assembly, the method comprising:

terminating a first cable to a first connector board;

terminating a second cable to a second connector board;

terminating a third cable to a third connector board;

terminating a fourth cable to a fourth connector board;

placing the first connector board on a housing base;

placing the second connector board on the housing base;

placing the third connector board on the housing base opposite to the first connector board;

placing the fourth connector board on the housing base opposite to the second connector board; and attaching a housing lid to the housing base such that the first connector board, the second connector board, the third connector board, and the fourth connector board are at least partially enclosed by the housing base and the housing lid.

14. The method of claim 13, further comprising:

placing an isolation plate on the housing base between the first connector board and the second connector board and a second isolation plate between on the housing base between the third connector board and the fourth connector board prior to attaching the housing lid.

* * * * *